US007997884B2

(12) United States Patent
Saito et al.

(10) Patent No.: US 7,997,884 B2
(45) Date of Patent: Aug. 16, 2011

(54) ROTARY DEVICE AND OIL PUMP HAVING α-ALUMINA AND ZIRCONIA COATING

(75) Inventors: Toshiyuki Saito, Toyoake (JP); Takumi Mio, Kariya (JP); Masahiro Suzuki, Kashiba (JP); Tomoyoshi Konishi, Hiratsuka (JP); Arata Suda, Yokohama (JP); Mikito Toyoshima, Hiratsuka (JP)

(73) Assignees: JTEKT Corporation, Osaka-shi (JP); Nihon Parkerizing Co., Ltd., Tokyo (JP)

( * ) Notice: Subject to any disclaimer, the term of this patent is extended or adjusted under 35 U.S.C. 154(b) by 394 days.

(21) Appl. No.: 12/206,300

(22) Filed: Sep. 8, 2008

(65) Prior Publication Data

US 2009/0068049 A1 Mar. 12, 2009

(30) Foreign Application Priority Data

Sep. 7, 2007 (JP) ..... 2007-232523

(51) Int. Cl.
*F01C 21/00* (2006.01)
*F03C 2/00* (2006.01)

(52) U.S. Cl. ..... 418/178; 418/77; 418/133; 418/152

(58) Field of Classification Search ..... 418/77, 418/133, 152, 178, 179, 259
See application file for complete search history.

(56) References Cited

U.S. PATENT DOCUMENTS

| | | | | |
|---|---|---|---|---|
| 5,165,981 | A * | 11/1992 | Yamakawa et al. | 428/141 |
| 5,548,973 | A * | 8/1996 | Komine et al. | 252/68 |
| 6,234,776 | B1 * | 5/2001 | Hayashi et al. | 418/133 |
| 2008/0093223 | A1 * | 4/2008 | Yoshioka et al. | 205/322 |

FOREIGN PATENT DOCUMENTS

| | | | | |
|---|---|---|---|---|
| JP | 2007-132237 | | 5/2007 | |
| WO | WO 2005118919 | A1 * | 12/2005 | 205/322 |

* cited by examiner

*Primary Examiner* — Theresa Trieu
(74) *Attorney, Agent, or Firm* — Oblon, Spivak, McClelland, Maier & Neustadt, L.L.P.

(57) ABSTRACT

An oil pump has: a base part having a working chamber; and a rotor provided rotatably in the working chamber. The base part is configured by a plurality of split bodies. At least one of the plurality of split bodies is made of aluminum alloy, and on which an opposed sliding surface made of a ceramic film is formed. The ceramic film of the opposed sliding surface has a hardness of approximately Hv 500 to 1100 and a surface roughness of approximately 2 to 8 micrometers, and contains α-alumina and zirconia.

11 Claims, 5 Drawing Sheets

ROTARY DEVICE AND OIL PUMP HAVING α-ALUMINA AND ZIRCONIA COATING

INCORPORATION BY REFERENCE

The disclosure of Japanese Patent Application No. 2007-232523 filed on Sep. 7, 2007 including the specification, drawings and abstract is incorporated herein by reference in its entirety.

BACKGROUND OF THE INVENTION

1. Field of the Invention

This invention relates to rotary equipment and an oil pump. This invention can be utilized in an oil pump used in, for example, a power steering device of a vehicle.

2. Description of the Related Art

A related art of an oil pump is explained as a typical example of rotary equipment. There is a conventional oil pump that has a base part having a working chamber, suction port and discharge port, and a rotor provided rotatably in the working chamber of the base part (Japanese Patent Application Publication No. 2007-132237 (JP-A-2007-132237)). This rotor has a rotor main body and vanes fitted into grooves provided on an outer peripheral part of the rotor main body. The vanes move in a centrifugal direction and centripetal direction as the rotor rotates. Consequently, the pressure of a chamber between adjacent vanes fluctuates and thereby oil is suctioned from the suction port and discharged from the discharge port. Here, the base part is configured by a front housing and rear housing. The rear housing has an opposed sliding surface which faces a sliding surface of the rotor main body and a sliding surface of each vane. The rear housing is formed from aluminum-silicon based alloy to attain weight reduction, high wear resistance and high strength.

In recent years, the pressure of oil discharged from an oil pump has been increasing with the improved power of an internal combustion engine. Therefore, the opposed sliding surface of the housing such as the rear housing might be worn away progressively, depending on the operating condition of the oil pump.

Especially curvature deformation sometimes occurs on the rear housing, due to the increased pressure inside the oil pump. In this case, wear of the opposed sliding surface of the rear housing progresses easily. As a result, the oil might leak out from between the opposed sliding surface of the rear housing and the sliding surface of the rotor main body or between the opposed sliding surface of the rear housing and the sliding surface of the vane. Therefore, the oil pump may not be able to offer its own capability if used for a long period of time. In recent years, the sliding condition is becoming more severe in other rotary equipment as well, such as a compressor.

For this reason, in the oil pump disclosed in JP-A-2007-132237, the opposed sliding surface of the rear housing is provided with an anodized aluminum film obtained by anodization using a low-temperature sulfate bath, in order to improve the wear resistance. However, because the anodized aluminum film is formed from γ-alumina in the abovementioned anodization and the hardness of the anodized aluminum film is approximately Hv 230 to 450, the wear resistance is not sufficient.

SUMMARY OF THE INVENTION

This invention provides rotary equipment and an oil pump that are useful in securing toughness and wear resistance of a ceramic film and securing the capability of the ceramic film while suppressing wear of a counterpart material even under a severe sliding condition.

An aspect of the invention has formed a ceramic film containing α-alumina and zirconia and having a hardness of Hv 500 to 1100 and a surface roughness of 2 to 8 micrometers on an opposed sliding surface on which a siding surface of a rotor of a base part of a housing or the like slides. Accordingly, wear of a counterpart material can be suppressed while securing toughness of the ceramic film, hardening the opposed sliding surface of the base part in an excellent way and improving wear resistance of the opposed sliding surface of the base part.

Rotary equipment of an embodiment of this invention has a base part, configured by a plurality of split bodies, having a working chamber, and a rotor, provided rotatably in the working chamber, on which a sliding surface is formed. In the rotary equipment, at least one of the plurality of split bodies is made of aluminum alloy, and on which an opposed sliding surface, formed of a ceramic film that contains α-alumina and zirconia and having a hardness of approximately Hv 500 to 1100 and a surface roughness of approximately 2 to 8 micrometers, is formed. The opposed sliding surface faces the sliding surface of the rotor that slides against the opposed sliding surface.

An oil pump of the embodiment of this invention has a base part, configured by a plurality of split bodies, having a working chamber, a suction port and a discharge port which communicate with the working chamber, and a rotor which is provided rotatably in the working chamber, suctions oil from the suction port and discharges the oil from the discharge port by rotating, and on which a sliding surface is formed. In the oil pump, at least one of the plurality of split bodies is made of aluminum alloy, and on which an opposed sliding surface, formed of a ceramic film that contains α-alumina and zirconia having a hardness of approximately Hv 500 to 1100 and a surface roughness of approximately 2 to 8 micrometers, is formed. The opposed sliding surface faces the sliding surface of the rotor that slides against the opposed sliding surface.

According to the above embodiment, the opposed sliding surface has a ceramic film containing α-alumina and zirconia and having a hardness of Hv 500 to 1100 and a surface roughness of 2 to 8 micrometers, so that the ceramic film is hardened to an appropriate level while securing the toughness of the opposed sliding surface. As a result, wear of a counterpart material is suppressed and the wear resistance of the opposed sliding surface is improved. Moreover, the ceramic film has an appropriate level of surface roughness. Therefore, good oil retention can be secured and the wear of the counterpart material can be further reduced. Hence, the wear of the counterpart material and the opposed sliding surface of the split body are suppressed even under a severe sliding condition.

According to the rotary equipment and oil pump according to the embodiment, wear of a counterpart material and the opposed sliding surface of the split body is suppressed even under a severe sliding condition. Therefore, this invention is useful in securing the capability of rotary equipment such as an oil pump over a long period of time.

Especially in the oil pump to which this embodiment is applied, the surface roughness and the hardness of the ceramic film of the opposed sliding surface of the rear housing are set as above so that the wear resistance of the opposed sliding surface is suppressed while suppressing wear of the rotor functioning as the counterpart material. As a result, the capability of the oil pump can be secured over a long period of time.

Furthermore, the ceramic film is provided with toughness by incorporating zirconia in the ceramic film. Hence, even if the pressure of the oil discharged from the oil pump is increased and curvature deformation occurs in the rear housing functioning as the split body, the ceramic film is not damaged easily by this curvature deformation. Therefore, even a high-pressure oil pump can secure the effect of suppressing the wear of the rotor functioning as the counterpart material and the wear of the opposed sliding surface of the rear housing.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein.

DETAILED DESCRIPTION OF THE PREFERRED EMBODIMENTS

Figure 1:
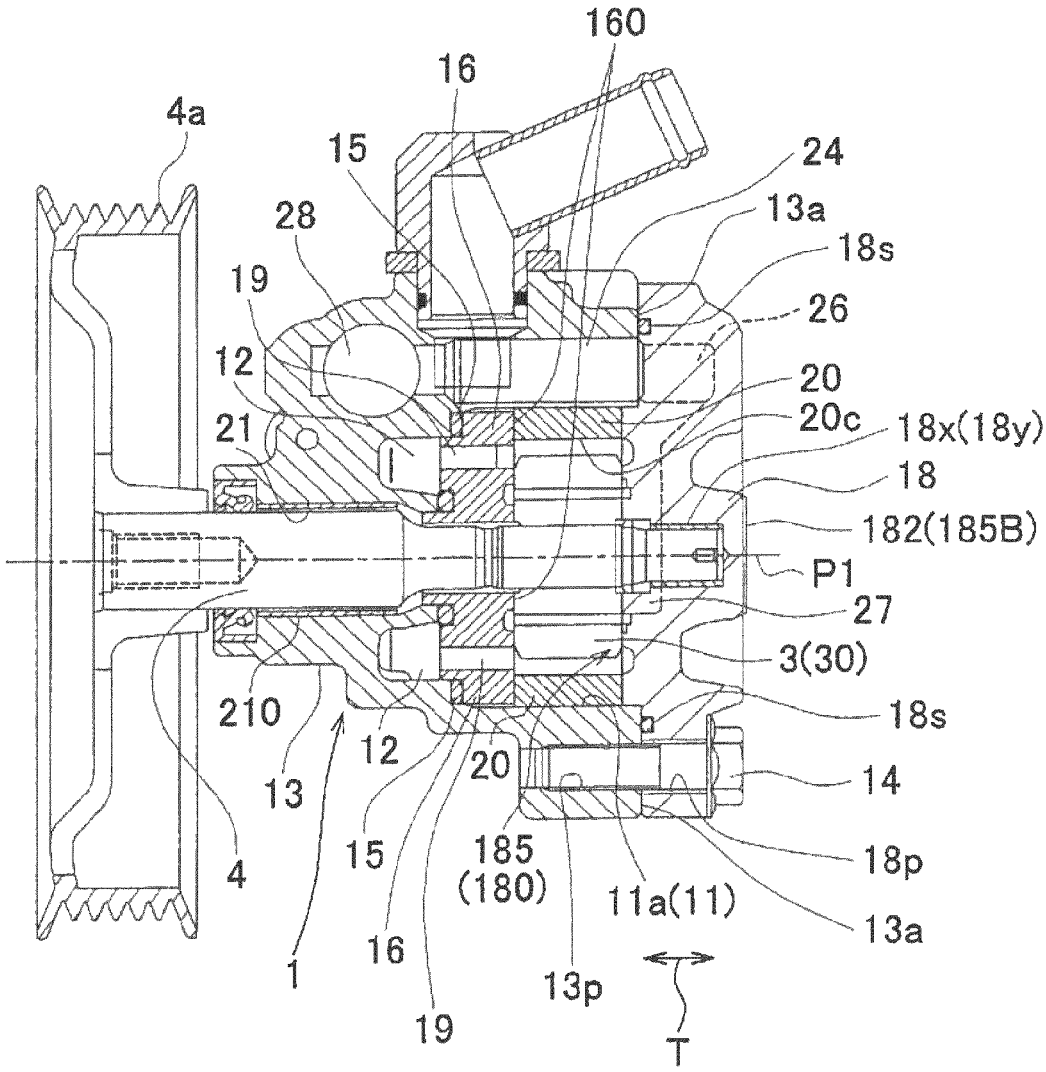
FIG. 1 is a cross-sectional diagram of an oil pump according to Embodiment 1.

In embodiments of this invention, the rotor may have a rotatable rotor main body having grooves on an outer peripheral surface of the rotor main body, and vanes that are fitted into the grooves of the rotor main body and activated in a centrifugal direction and centripetal direction as the rotor rotates. The ceramic film of the opposed sliding surface of one of the split bodies faces the rotor main body and a sliding surface of each vane so as to contact with the rotor main body and the sliding surface of the each vane. In this case, wear of the opposed sliding surface of the split body is suppressed.

The aluminum alloy configuring the split body may contain 1 to 25% by mass of silicon. Inclusion of silicon increases the hardness and strength of the aluminum alloy, thereby enhancing the split body. In this case, the silicon may be included at 5 to 20% by mass or 8 to 15% by mass. Note that the silicon content varies depending on the quality required in the split body, and the upper limit of the silicon content is, for example, 23%, 18%, 15%, 13%, or 11%. The lower limit that can be combined with the upper limit is, for example, 2%, 4%, 6%, 7%, or 9%.

The ceramic film according to the embodiment of this invention has a mixture of α-alumina and zirconia. The zirconia provides the ceramic film with toughness. The zirconia (zirconium oxide) can be tetragonal zirconia and/or cubic zirconia. Monoclinic zirconia may be present in the ceramic film. Although varying depending on the composition and the like of the ceramic film, the zirconia content can be 2 to 90%, 5 to 85%, 10 to 75%, or particularly 15 to 55% in relation to the 100% ceramic film in terms of mass ratio. The upper limit of the zirconia content is, for example, 85%, 80%, 75%, or 70% and the lower limit of the zirconia content that can be combined with the upper limit is, for example, 3%, 5%, 8%, or 10%, in relation to the 100% ceramic film in terms of mass ratio.

An anodized aluminum film that is generally formed on the aluminum alloy is formed from γ-alumina and generally has a barrier layer on a base side and a pore layer on a surface side which is laminated on the barrier layer and has micropores. The ceramic film of the embodiment of this invention, however, has a mixture of α-alumina and zirconia. Most part of alumina in the ceramic film of the embodiment of this invention may be α-alumina. Here, when the alumina constituting the ceramic film is 100%, α-alumina may be at least 50%, at least 60%, at least 70% or at least 80% in terms of mass ratio. In this case, a fairly hard ceramic film is obtained. Moreover, in addition to α-alumina, the ceramic film of the embodiment of this invention may contain alumina of other phase, such as γ-alumina and/or β-alumina. When a mixture of α-alumina and γ-alumina is present in the ceramic film, α-alumina and γ-alumina exist at a ratio of α-alumina/γ-alumina=0.95 to 0.05, 0.80 to 0.20, 0.70 to 0.30, or in some cases 0.60 to 0.40 in terms of mass ratio. When the mixture of α-alumina and γ-alumina is present in the ceramic film as the alumina constituting the ceramic film, it is desired that the characteristics of α-alumina that is harder than γ-alumina be combined with the characteristics of γ-alumina that is comparatively softer than α-alumina, so that excessive hardening of the ceramic film is further inhibited.

If the ceramic film is thin, a poor effect is produced. If the ceramic film is excessively thick, the productivity is reduced. The thickness of the ceramic film is, for example, 2 to 300 micrometers, 5 to 200 micrometers, 5 to 100 micrometers, or 10 to 50 micrometers. If the ceramic film has the above thickness, it is expected that, even when the matrix has a silicon phase, the ceramic film cover both the silicon phase and eutectic phase of the base framework of the aluminum alloy in an excellent way. In this case, the ceramic film is useful in preventing the silicon phase from being removed.

The internal hardness of a central region in a thickness direction of a parent material constituting each split body may be Hv 100 to 300 or Hv 100 to 200. The film hardness of the ceramic film is generally Hv 500 to 1100 or Hv 500 to 1000, which is not excessively high. Therefore, the durability of the ceramic film against curvature deformation of the abovementioned split body is improved while securing the wear resistance and toughness of the ceramic film in an excellent way. The upper limit of the hardness of the ceramic film is, for example, Hv 1100, Hv 900, or Hv 800. The lower limit that can be combined with the upper limit is, for example Hv 600, Hv 650, or Hv 700. Hv means Vickers hardness.

If the surface roughness of the ceramic film is high, wear of a counterpart material is increased. If, on the other hand, the surface roughness of the ceramic film is low, the wear of the counterpart material is reduced. In view of this point, the surface roughness of the ceramic film can be 2 to 8 micrometers, 3 to 8 micrometers, or 4 to 8 micrometers in Rz (JIS). When the surface roughness of the ceramic film is in the abovementioned range, the wear of the counterpart material can be suppressed more than when the surface roughness of the opposed sliding surface is higher than that of the ceramic film, and good oil retention can be secured on the opposed sliding surface as compared to when the surface roughness of the ceramic film is low. Examples hereinafter describe a pattern in which the rotor is held between the ceramic film (oil retention thereof is expected) formed on the opposed sliding surface of the split body and an oil-containing member disposed in the working chamber. In this case, the ceramic film is useful in securing oil lubricity on both sides of the rotor when the rotor rotates.

As described above, it is desired that the surface roughness of the ceramic film be 8.0 micrometers or lower in order to suppress the wear of the counterpart material and prevent harmful wear of the counterpart material (rotor). Therefore, the hardness and surface roughness of the ceramic film is in the abovementioned ranges (hardness being Hv 500 to 1100 and surface roughness being 2 to 8 micrometers) in order to improve the wear resistance of the split body and obtain good oil retention.

The abovementioned ceramic film may be formed by plasma electrolytic processing (plasma electrolytic oxidation processing). When subjecting the split body having aluminum alloy as the parent material to the plasma electrolytic processing, first the split body may be cleansed (e.g., degreasing or etching). Thereafter, the split body is immersed in a processing bath accumulating an electrolytic solution such as solution containing a zirconium compound. In this state, a predetermined voltage (e.g., 200 to 800 volts) is applied between the split body taken as the positive electrode and a counterpart electrode taken as the negative electrode for a predetermined amount of time (e.g., 1 to 45 minutes or 5 to 30 minutes) to form the ceramic film. The zirconium compound may be water-soluble. The water-soluble zirconium compound is useful in densifying the ceramic film. Examples of the water-soluble zirconium compound include: zirconium salt of an organic acid such as zirconium acetate, zirconium formate and zirconium lactate; zirconium carbonate compound such as ammonium zirconium carbonate and potassium zirconium carbonate; and at least one type of zirconium complex salts such as ammonium zirconium acetate, sodium zirconium oxalate, sodium zirconium citrate, ammonium zirconium lactate and ammonium zirconium glycolate. The zirconium compound content in the electrolytic solution is set appropriately at, for example, 0.0001 to 5 mol/litter, 0.001 to 0.5 mol/litter, or in some cases 0.01 to 0.05 mol/litter in terms of zirconium. The pH of the electrolytic solution may be at least 8.0 or at least 9.0. The temperature of the electrolytic solution is normally 10 to 60° C.

Examples of an electrolytic method include a DC electrolytic method, a bipolar electrolytic method, and a pulse electrolytic method. Electrolyzation may be performed during glow discharge and arc discharge. Glow discharge and arc discharge may occur simultaneously or either one may occur alone. Glow discharge is a phenomenon in which the entire surface is surrounded by continuous light. Arc discharge is a phenomenon in which sparks are generated intermittently or locally. Although the reason that the abovementioned ceramic film is formed by plasma electrolytic processing is not necessarily defined clearly, it is speculated that the zirconium contained in the electrolytic solution be introduced to the film as zirconia (zirconium oxide) when an alumina film is formed by electrolytic processing. In the bipolar electrolytic method described above, a voltage waveform that is obtained by superposing an AC component on a DC component may be used. In the pulse electrolytic method, a voltage waveform that is obtained by superposing a rectangular wave, a sine wave and a triangle wave on a DC voltage component or an AC voltage component at a predetermined duty ratio (e.g., 0.5 or lower) may be used. The maximum value of the voltage waveform may be 300 to 900 volts or 400 to 800 volts. When the voltage is high, spark discharge, glow discharge, or arc discharge might occur. In this case, the current density of this voltage might have an impact on the surface roughness of the ceramic film. Therefore, the peak value of the positive electric potential of the current density may be 1 to 250 A/dm2, or 20 to 150 A/dm2.

Embodiment 1 of this invention is described with reference to FIGS. 1 and 2. The entire configuration of this invention is described first. The oil pump, used in a power steering device for assisting the steering operation of a vehicle, is rotated by a crankshaft of an engine. As shown in FIG. 1, a base part 1 constitutes a base material made of aluminum alloy, and has a front housing 13 (first housing, split body) and a rear housing 18 (second housing, split body). The front housing 13 has a working chamber 11 and a discharge chamber 12. The working chamber 11 is partitioned with an inner wall surface 11*a*. The discharge chamber 12 communicates with the working chamber 11. The rear housing 18 is fixed to an attachment end surface 13*a* of the front housing 13, and constitutes a part of a housing of the oil pump.

The inside the working chamber 11 is provided with a first side plate 16 (oil-containing member) that is fitted into the working chamber 11 via a sealing part 15 so as to face the discharge chamber 12. The first side plate 16 has a flat opposed sliding surface 160 that faces a sliding surface of a rotor main body 30 of a rotor 3 and a sliding surface of a vane 31. The first side plate 16 is an iron-based sintered article obtained by sintering an iron-based compacted body, and has a hardness of approximately Hv 150 to 300 or particularly 180 to 250, but is not limited to this iron-based sintered article. The specific gravity of the first side plate 16 is approximately 6.3 to 7.2 or 6.5 to 7.0 and has a large number of micropores. A good oil lubricity can be expected from these micropores having oil retainability.

The rear housing 18 is fixed to the attachment end surface 13*a* of the front housing 13 via a sealing part 18*s* by inserting an attachment bolt 14 (attachment tool) into a through-hole 18*p* of the rear housing 18 and screwing it into a screw hole 13*p* of the front housing 13. A discharge port 19 communicating with the discharge chamber 12 and the working chamber 11 is formed in the thickness direction of the first side plate 16. A cam ring 20 is fitted into the working chamber 11 so as to be held between the first side plate 16 and the rear housing 18.

A shaft hole 21 is formed in the front housing 13 so as to be connected to the working chamber 11. A suction passage 24 is formed in the front housing 13. The suction passage 24 is communicated with a suction port 27 through a suction communication path 26 of the rear housing 18.

Figure 2:
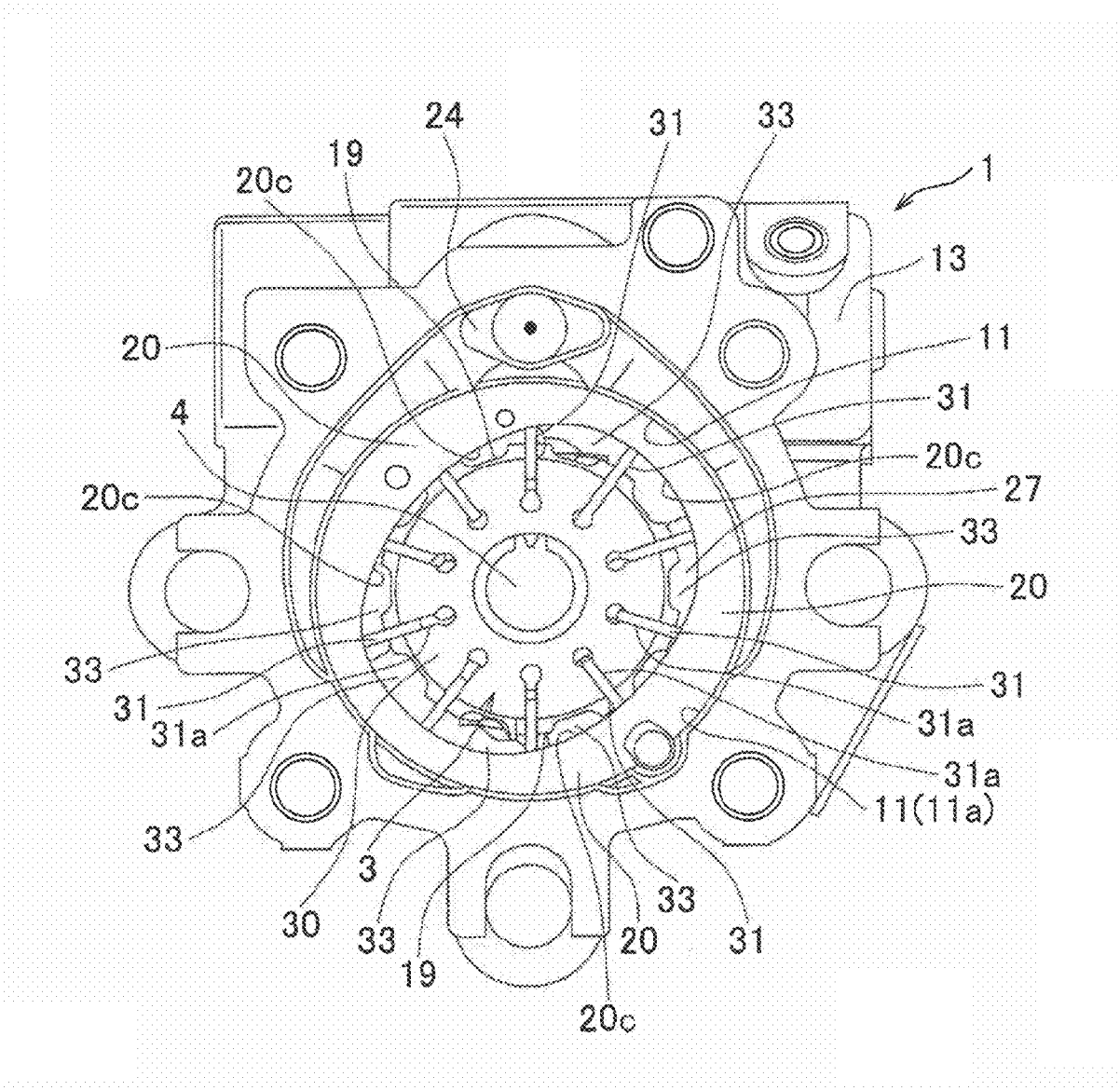
FIG. 2 is a cross-sectional diagram of the oil pump of Embodiment 1 which is viewed from a different direction.

As shown in FIG. 2, the rotor 3 is provided rotatably in the cam ring 20 of the working chamber 11. The rotor 3 performs pumping operation by suctioning oil from the suction port 27 by rotating, discharging the oil to the discharge chamber 12 through the discharge port 19 and thus supplying the oil to a discharge passage 28. The rotor 3 has the rotor main body 30 rotating inside the cam ring 20 (the rotor main body 30 being obtained by carburizing and quenching a sintered article formed from iron-based alloy, and having a hardness of approximately Hv 550 to 850 or particularly approximately Hv 600 to 800), and a plurality of blade-like vanes 31 fitted into grooves 31*a* of the rotor main body 30 in a radiation direction (the vanes 31 being cut products made of iron-based alloy and having a hardness of approximately Hv 650 to 950 or particularly approximately Hv 700 to 900). The iron-based rotor main body 30 is formed from a material obtained by carburizing and then quenching a sintered article, and is hardened and provided with high strength.

As shown in FIG. 1, the discharge passage 28 is formed in the front housing 13. The discharge passage 28 is provided with a conventional flow control valve (e.g., a flow control valve 2 described in Japanese Patent No. 3744145). The discharge passage 28 is communicated with the discharge chamber 12 and with the working chamber 11 via the discharge chamber 12 and the discharge port 19. The discharge passage 28 is further communicated with the suction passage 24. A drive shaft 4 (iron-based cut product, P1: shaft core) with a pulley 4*a*, which is formed from carbon steel or alloy steel, is supported rotatably in a shaft hole 21 via a metal bearing 210 and engaged integrally with a hole of the rotor main body 30 of the rotor 3.

The pulley 4*a* that is coupled to the crankshaft of the engine via an endless belt rotates. Consequently, the drive shaft 4 and the rotor 3 rotate. As a result, the rotor 3 and the vanes 31 rotate in the same direction in the cam ring 20. Leading ends of the vanes 31 move along a cam surface 20*c* of the cam ring 20. The vanes 31 disposed adjacent to each other form a chamber 33. The chamber 33 on the suction port 27 side has a large capacity relative to the one on the suction port 19 side, in order to secure a capability of suctioning the oil from the suction port 27. The chamber 33 on the discharge port 19 side has a small capacity relative to the one on the suction port 27 side.

The configuration of each component is described next. The rear housing 18 is formed from foundry aluminum alloy (equivalent to ADC12, die-cast article) containing 8 to 16% by mass or particularly 10 to 15% by mass of silicon. The rear housing 18 has an opposed sliding surface 180. The opposed sliding surface 180 faces the sliding surface (end surface) of the rotor main body 30 of the rotor 3 and the sliding surface (end surface) of each vane 31. The entirety of the rear housing 18 is subjected to the plasma electrolytic processing so as to form a ceramic film 185 that contains α-alumina and zirconia as the main components. Sealing processing is not performed on this ceramic film. Therefore, the ceramic film 185 with wear resistance and toughness is formed on the surface of the opposed sliding surface 180 of the rear housing 18.

The rear housing 18 has an exposed surface 182 having its back to the working chamber 11 and exposed to the outside. On the exposed surface 182 as well, a ceramic film 185B similar to the ceramic film 185 is formed.

When subjecting the abovementioned rear housing 18 to the plasma electrolytic processing, first the rear housing 18 is degreased. Thereafter, as described in International Publication No. WO2005-118919, a solution containing a zirconium compound (potassium zirconium carbonate, 0.01 mol/litter), sodium pyrophosphate (0.015 mol/litter), and potassium hydrate (0.036 mol/litter) (the solution having a pH of at least 9.0 but no more than 13.5, 10 to 60° C.) is used as an electrolytic solution. Here, the zirconium compound is added to the electrolytic solution in an amount of 0.0001 to 5 mol/litter in terms of zirconium. The rear housing 18 is immersed in a processing bath accumulating this electrolytic solution. In this state, a voltage of 300 to 800 volts is applied between the rear housing 18 taken as the positive electrode and a stainless steel plate taken as the negative electrode for 1 to 45 minutes to form the ceramic film 185. In this case, the AC component is superposed on the DC component. In the plasma electrolytic processing, light emitted by spark discharge and glow discharge is observed. With this processing described above, the ceramic films 185, 185B containing α-alumina and zirconia as the main components are formed. The ceramic films 185, 185B have little micropores formed thereon.

The internal hardness of a central region in the thickness direction of the rear housing 18 is Hv 130 to 160, and the hardness of the ceramic film 185 is Hv 500 to 1100 or particularly 700 to 1000 (measuring load for Hv is 100 g). Because the ceramic film 185 does not have excessive hardness as above, appropriate levels of wear resistance and toughness can be provided in the ceramic film 185.

Note that the hardness of the ceramic film 185 is higher than the average hardness of the iron-carbon-based first side plate 16 (e.g., Hv 500 to 800) but is not excessively high, hence the wear resistance and toughness can be secured and wear of the counterpart material can be suppressed.

Generation of the α-alumina phase and zirconia in the ceramic film 185 can be confirmed by X-ray diffraction. In addition to α-alumina, γ-alumina is also generated in the ceramic film 185, according to the X-ray diffraction. The ratio of α-alumina to γ-alumina is α-alumina/γ-alumina=0.80 to 0.20 in terms of mass ratio. Therefore, the effect of combining the hard α-alumina with the relatively soft γ-alumina can be expected in the ceramic film 185. Note that the proportion of the α-alumina may be 50% or more in relation to the 100% ceramic film 185 in terms of mass ratio.

As described above, according to this embodiment, the abovementioned ceramic films 185, 185B are formed by the plasma electrolytic processing. As a result, the surface hardness of the opposed sliding surface 180 of the rear housing 18 is increased. Because the wear resistance of the opposed sliding surface 180 of the rear housing 18 is improved, wear of the opposed sliding surface 180 is reduced even when the opposed sliding surface 180 slides with the sliding surface of the rotor main body 30 of the rotor 3 and the sliding surface of each vane 31. Seizure resistance is also enhanced. Therefore, the mobility of the vanes 31 in the centrifugal direction and centripetal direction can be maintained smoothly over a long period of time, and the primary capability of the oil pump can also be maintained well.

According to this embodiment in which the opposed sliding surface 180 of the rear housing 18 is hardened by forming the ceramic film 185 on the surface of the opposed sliding surface 180, the discharge pressure of the oil pump is set higher than that of the related art (e.g., 8 MPa→15 MPa). Even when a curvature deformation occurs on the rear housing 18 due to the increased pressure, excessive wear of the opposed sliding surface 180 of the rear housing 18 can be suppressed. Therefore, it is possible to prevent oil leakage from between the opposed sliding surface 180 of the rear housing 18 and the sliding surface of the rotor main body 30 of the rotor and between the opposed sliding surface 180 of the rear housing 18 and the sliding surface of each vane 31. Accordingly, the primary capability of the oil pump can be maintained well, even when the discharge pressure of the oil pump is high.

Because the opposed sliding surface 180 of the rear housing 18 slides with the sliding surface of the rotor main body 30 of the rotor and the sliding surface of each vane 31 under an oil environment, the sliding oppose surface 180 is subjected to flattening treatment before the plasma electrolytic processing, in order to achieve flatness of high precision. Here, the surface roughness of the opposed sliding surface 180 of the rear housing 18 was 1 micrometer in Rz (JIS) before forming the ceramic film 185. On the other hand, the surface roughness of the ceramic film 185 was 2 to 8 micrometers or particularly 4 to 8 micrometers in Rz (JIS). The surface roughness was measured in accordance with JISB0601 (1994).

In this manner, an appropriate level of surface roughness is obtained in the opposed sliding surface 180 of the rear housing 18 by performing plasma electrolytic processing thereon while performing flattening treatment to obtain flatness of high precision. Therefore, unlike the conventional article without the ceramic film 185 formed thereon, it is expected that loss of oil film (oil film followability) be prevented and retention of the oil film in the opposed sliding surface 180 of the rear housing 18 be improved. In this light, wear of the opposed sliding surface 180 of the rear housing 18 can be reduced and the primary capability of the oil pump can be maintained well.

The rear housing 18 is formed from aluminum alloy containing 8 to 16% by mass or particularly 10 to 15% by mass of silicon in order to strengthen the alloy as described above. Determining this metal based on an equilibrium diagram for the aluminum-silicon system, the metal structure of the opposed sliding surface 180 is basically formed from a mixture of a silicon phase and a metal phase, considering the cooling speed. Here, because the electrical conductivity varies between the silicon phase and the metal phase during the plasma electrolytic processing, the current density and growth rate vary between the silicon phase and the metal phase. As a result, it is speculated that an appropriate level of surface irregularity occurs in the ceramic film and accordingly the above-described surface roughness is expressed. Note that it is expected that both the silicon phase and metal phase of the aluminum alloy can be covered in an excellent way as long as the ceramic film 185 has the thickness described above.

According to this embodiment, the specific gravity of the iron-based first side plate 16 is 6.4 to 7.0 or particularly 6.7 to 6.9, which is comparatively small as an iron-based component, and has a large number of micropores and oil retainability. Therefore, good oil lubricity and slidability are secured between the opposed sliding surface 160 of the first side plate 16 and the rotor 3.

According to this embodiment, the rotor 3 is held between the rear housing 18 formed from aluminum alloy and the first side plate 16 which is an iron-based sintered component (iron-based oil-containing member, sintered body) in the thickness direction (direction of an arrow T) of the rotor main body 30 as shown in FIG. 1, the rear housing 18 being provided with the opposed sliding surface 180 which has the ceramic film 185 containing $\alpha$-$Al_2O_3$ and zirconia as the main components. Preferably, there is no significant difference between the lubricity obtained between the rotor 3 and the first side plate 16 and the lubricity obtained between rotor 3 and the rear housing 18 so that the smooth operability between the rotor main body 30 and vanes 31 configuring the rotor 3 is improved.

In this light, according to this embodiment, the ceramic film 185 containing $\alpha$-alumina and zirconia as the main components has an appropriate level of surface roughness and oil retention, while the first side plate 16 has a large number of micropores and oil retainability, as described above. Therefore, good oil lubricity can be expected between the first side plate 16 and the rotor 3. Moreover, because the opposed sliding surface 180 of the rear housing 18 has the ceramic film 185 with an appropriate level of surface roughness, better oil retention can be expected in the opposed sliding surface 180, as compared to the conventional article without the ceramic film 185. According to this embodiment, good oil lubricity can be expected on both surfaces formed in the axial direction of the rotor 3 (direction of the arrow T). Consequently, good operability is secured in the rotor main body 30 and vanes 31 configuring the rotor 3.

According to this embodiment, the ceramic film 185B with high hardness (same as the ceramic film 185) is also formed on the exposed surface 182 that is exposed to the air in the rear housing 18. Therefore, the wear resistance of the exposed surface 182 can be improved, and the exposed surface 182 can be protected from being damaged even when other parts collide with the exposed surface 182 at the time of storing or assembling. The rear housing 18 also has a shaft hole 18*x* into which the shaft 4 is fitted. The ceramic film 185 containing $\alpha$-alumina as the main component is also formed on an inner peripheral surface 18*y* of the shaft hole 18*x*. Therefore, wear resistance of the inner peripheral surface 18*y* of the shaft hole 18*x* is improved even when the shaft 4 is driven to rotate at high speed inside the shaft hole 18*x*. Note that, although the front housing 13 (split body) is not subjected to the plasma electrolytic processing, the same type of ceramic film may be formed in the front housing 13 as well.

(Test Example) A test example corresponding to this embodiment is now described. Specifically, a test example was implemented using a test piece made of aluminum alloy (basic composition: 14.0 to 16.0 mass % of silicon, 2.5 to 4% of copper, and 0.7 to 0.9% of magnesium, with a Rockwell hardness (B scale) of HRB 80 to 84). In this case, after degreasing the test piece, a solution containing a zirconium compound in an amount of 0.0001 to 5 mol/litter in terms of zirconium (solution having a pH of at least 9.0 but no more than 13.5, 10 to 60° C.) was used as the electrolytic solution, and the rear housing 18 was immersed in the processing bath accumulating this electrolytic solution, as described in International Publication No. WO2005-118919. In this state, the plasma electrolytic processing was carried out. Specifically, a maximum voltage of 300 to 800 volts was applied between the rear housing 18 taken as the positive electrode and a stainless steel plate taken as the negative electrode for 1 to 45 minutes to form the ceramic film. In this case, the bipolar electrolytic method in which the AC component is superposed on the DC component was used. By performing this processing described above, the ceramic film having little micropores is formed.

The surface roughness of this ceramic film is 2.0 to 4.0 micrometers in Rz (JIS), the film thickness 4 to 10 micrometers, and the hardness Hv 800 to 1100. Note that the measuring load of the hardness Hv is 10 g (Hv 0.01). According to this ceramic film with the test piece, generation of $\alpha$-alumina and zirconia as the main phases in this ceramic film is confirmed by X-ray diffraction. Moreover, in addition to $\alpha$-alumina, $\gamma$-alumina is also generated in the ceramic film. The ratio of $\alpha$-alumina to $\gamma$-alumina is $\alpha$-alumina/$\gamma$-alumina=0.80 to 0.20 in terms of mass ratio.

Figure 3:
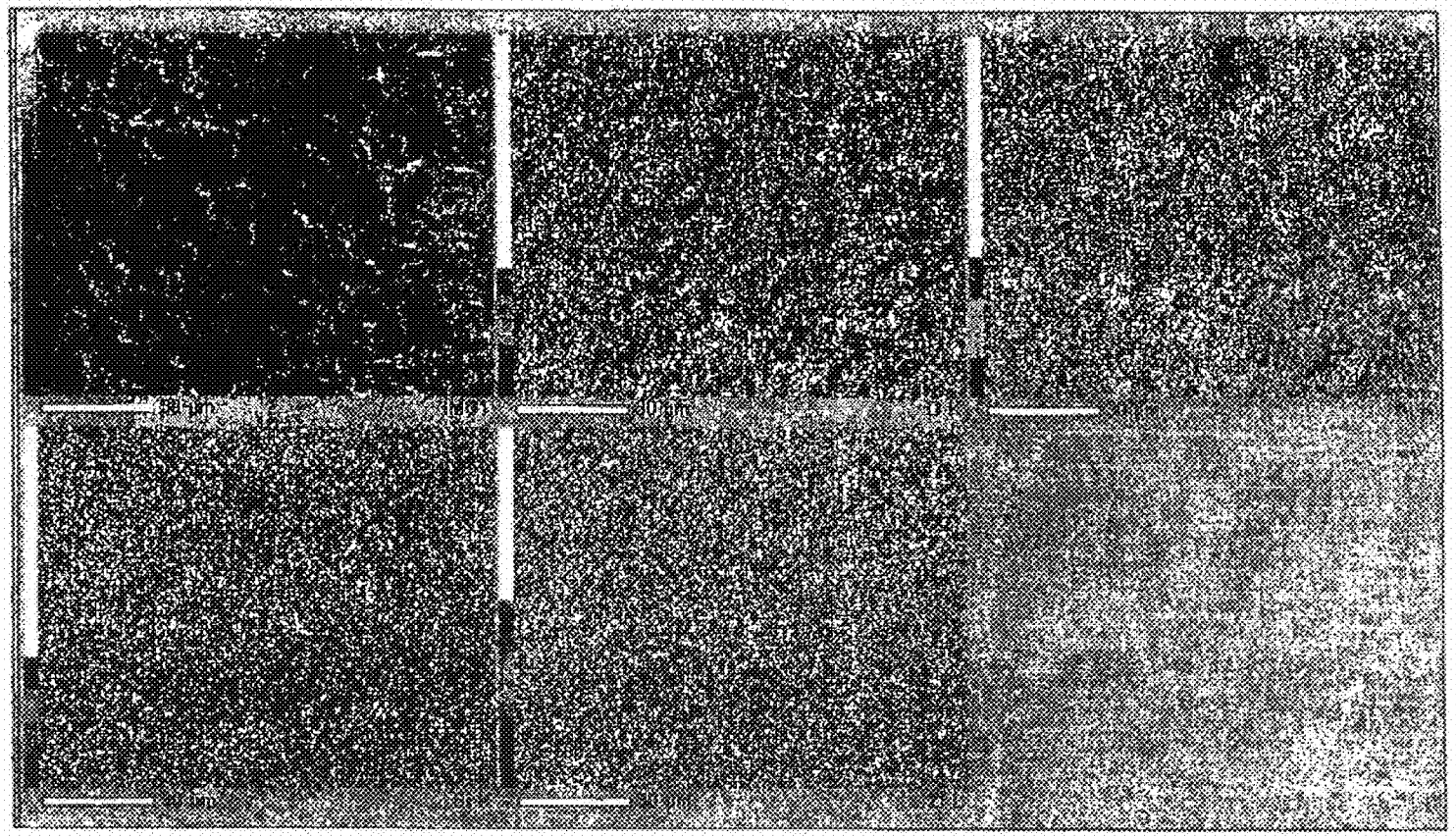
FIG. 3 is a photographic diagram showing the result of EPMA measurement performed on a ceramic film.

FIG. 3 shows the result of EPMA measurement performed on the abovementioned ceramic film. In FIG. 3, the top left image IMG1 shows an SEM image of the surface of the ceramic film (unit distance: 30 μm). As is understood from this image, the ceramic film having an appropriate level of surface roughness is formed. The ceramic film has little pinhole-like micropores. In FIG. 3, "OK" described at the bottom of the upper middle image indicates oxygen distribution, and "AlK" described on the top right image indicates aluminum distribution. "SiK" described on the lower left image indicates silicon distribution, and "ZrK" described at the bottom of lower middle image indicates zirconium distribution. Zirconium is dispersed well in the ceramic film along with aluminum, silicon, and oxygen. According to an EPMA analysis, the content of the zirconia is 10 to 40% or particularly 15 to 35% in relation to the 100% ceramic film in terms of mass ratio, and the rest is constituted by inevitable impurities and alumina.

A comparative example was similarly tested. Specifically, after degreasing the same type of test piece, the test piece was immersed in a low-temperature sulfate bath accumulating a sulfate-containing solution. In this state, voltage is applied between the test piece taken as the positive electrode and the negative electrode, and hard alumite treatment was performed followed by the sealing processing. In this case, the bath voltage is 10 to 30 volts, the current density 50 to 200 A/dm2, and the bath temperature 8 to 25° C. In this comparative example, although a film composed of γ-alumina was generated, a film having α-alumina as the main component was not generated. The surface roughness of the film of Comparative Embodiment 1 was 3.6 micrometers in Rz (JIS), the film thickness 7 to 10 micrometers, and the hardness Hv 200.

Figure 4:
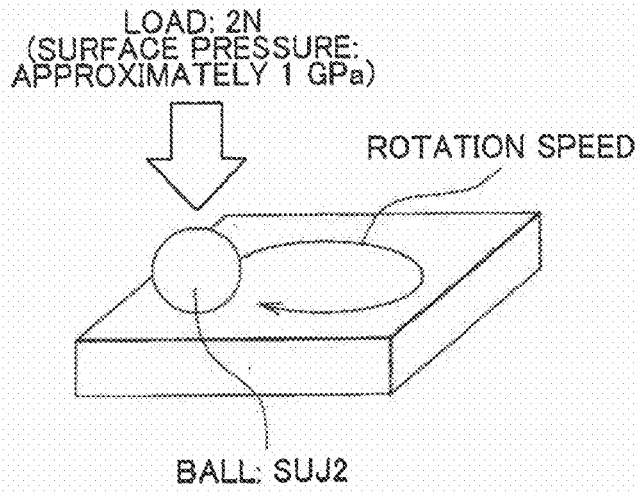
FIG. 4 is a diagram showing the result of a frictional wear test.

A frictional test (ball-on-disk test) was performed on the test piece used in the above test example. In the frictional test, a ball on which the test piece ceramic film is mounted (JIS-SUJ2) was slid on the surface of the test piece in an oil solution by a predetermined load, as shown in FIG. 4. The sliding conditions were set such that a load was 5 N, the oil solution a power steering oil, the oil temperature 100° C., the rotation speed of the ball 290 rpm, and the sliding time 30 minutes. The friction test was also performed on the test piece used in the comparative example.

Figure 5:
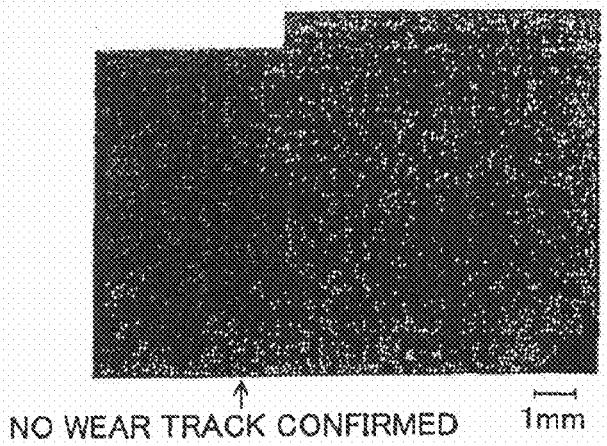
FIG. 5 is a photographic diagram showing a wear track formed on a ceramic film according to a test example.
Figure 6:
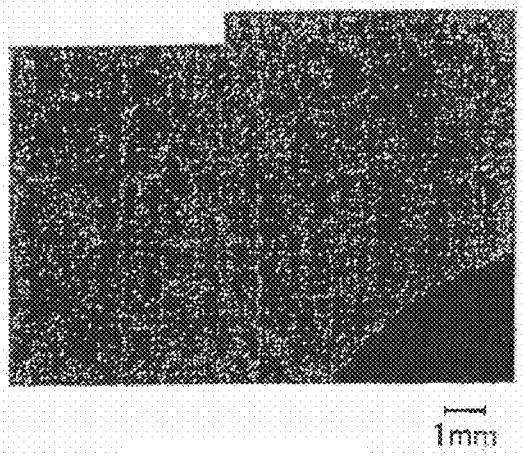
FIG. 6 is a photographic diagram showing a wear track formed on a ceramic film according to a comparative example.

FIG. 5 shows a wear track formed on the test piece ceramic film of this embodiment (unit distance: 1 mm). FIG. 6 shows a wear track formed on the test piece ceramic of the comparative example (unit distance: 1 mm). As shown in FIG. 5, almost no wear track is confirmed on the test piece ceramic film of this embodiment. On the other hand, a wear track is confirmed on the test piece film of the comparative example, as shown in FIG. 6.

Figure 7:
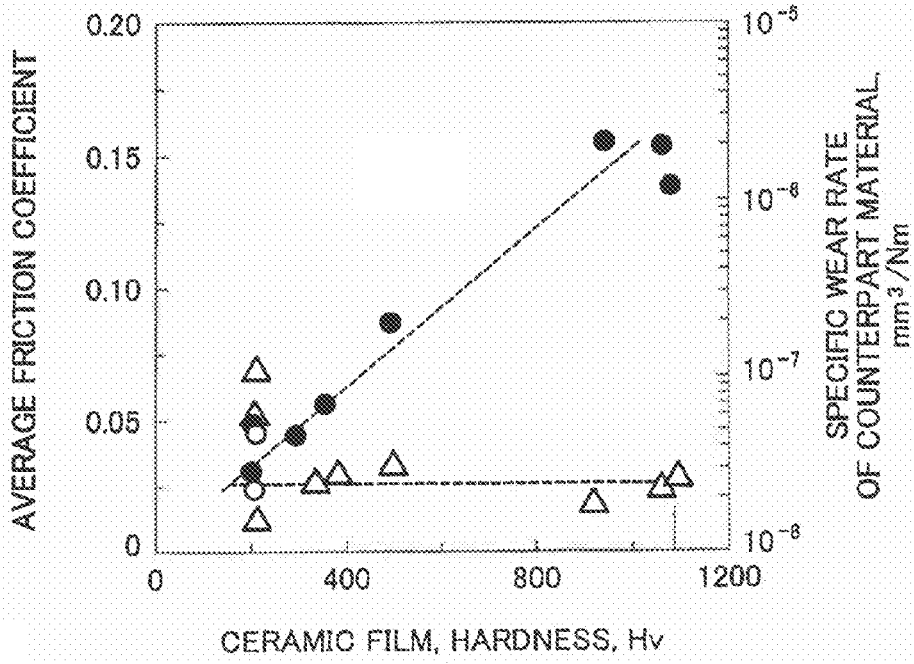
FIG. 7 is a graph showing the relationship of the hardness of the ceramic film used in the test example to average friction coefficient and to specific wear rate of a counterpart material.

FIG. 7 shows the relationship of the hardness of the ceramic film used in the above test example corresponding to this embodiment to average friction coefficient and to specific wear rate of a counterpart material (ball). In FIG. 7, Δ indicates the average friction coefficient, and • the specific wear rate of the counterpart material (ball). As shown in FIG. 7, the specific wear rate of the counterpart material (wear of the counterpart material) is kept low when the hardness is Hv 500 to 1100. Here, the specific wear rate of the counterpart material (ball) tends to increases as the hardness of the ceramic film increases.

Figure 8:
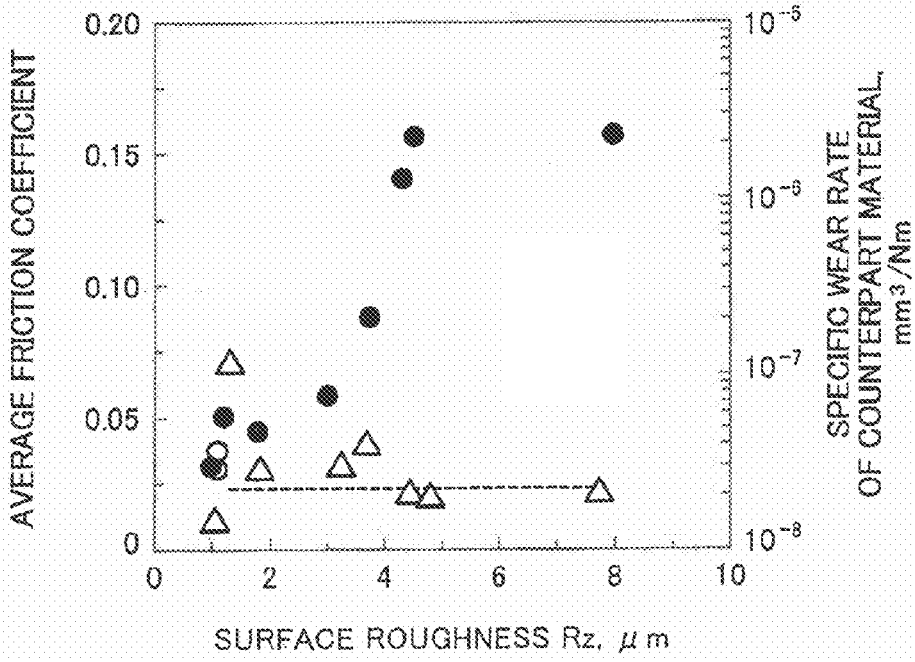
FIG. 8 is a graph showing the relationship of the surface roughness of the ceramic film used in the test example to the average friction coefficient and to the specific wear rate of the counterpart material.

FIG. 8 shows the relationship of the surface roughness (Rz (JIS)) of the ceramic film used in the above test example corresponding to this embodiment to the average friction coefficient and to the specific wear rate of the counterpart material (ball). In FIG. 8, Δ indicates the average friction coefficient, and • the specific wear rate of the counterpart material (ball). As shown in FIG. 8, the specific wear rate of the counterpart material (ball) (wear of the counterpart material) is kept low when the surface roughness of the ceramic film is 2 to 8 micrometers. Here, the specific wear rate of the counterpart material (ball) (wear of the counterpart material) tends to increases as the surface roughness of the ceramic film increases.

Embodiment 2 has basically the same configuration and operation effect as Embodiment 1. FIGS. 1 and 2 are correspondingly applied. In this embodiment as well, as in Embodiment 1, the rear housing 18 has the opposed sliding surface 180 that faces the sliding surface of the rotor main body 30 of the rotor 3 and the sliding surface of each vane 31. The ceramic film 185 containing α-alumina and zirconia as the main components is formed on the surface of the opposed sliding surface 180 of the rear housing 18 by alumite treatment. Sealing processing is not performed on the ceramic film 185 as it has few holes.

Moreover, according to Embodiment 2, the first side plate 16 is not iron based but is formed from aluminum alloy (equivalent to ADC12, die-cast article) containing 8 to 16% by mass or particularly 10 to 15% by mass of silicon. The first side plate 16 has the opposed sliding surface 160 that faces the sliding surface of the rotor main body 30 of the rotor 3 and the sliding surface of each vane 31. A ceramic film containing $\alpha$-$Al_2O_3$ and zirconia as the main components (corresponding to the ceramic film 185) is formed on the surface of the opposed sliding surface 160 of the first side plate 16 by the plasma electrolytic processing. Sealing processing is not performed on this ceramic film as it has few micropores.

Embodiment 3 has basically the same configuration and operation effect as Embodiment 1. FIGS. 1 and 2 are correspondingly applied. According to Embodiment 3, the rear housing 18 is formed from aluminum-silicon based alloy having a hypereutectic composition. The entirety of the rear housing 18 is subjected to the plasma electrolytic processing so as to form a ceramic film that contains α-alumina and zirconia as the main components. Sealing processing is not performed on this ceramic film. Therefore, the ceramic film 185 is formed on the surface of the opposed sliding surface 180 of the rear housing 18.

Embodiment 4 has basically the same configuration and operation effect as Embodiment 1. FIGS. 1 and 2 are correspondingly applied. In Embodiment 4 as well, as in Embodiment 1, the rear housing 18 has the opposed sliding surface 180 that faces the sliding surface of the rotor main body 30 of the rotor 3 and the sliding surface of each vane 31. The ceramic film 185 is formed on the surface of the opposed sliding surface 180 of the rear housing 18. The ceramic film 185B is also formed on the exposed surface 182 having its back to the working chamber 11 in the rear housing 18. The ceramic film 185 of the opposed sliding surface 180 is thicker than the ceramic film 185B of the exposed surface 182. In this case, the wear resistance of the opposed sliding surface 180 of the rear housing 18 can be improved while minimizing the cost of the plasma electrolytic processing. When the plasma electrolytic processing is performed, voltage is applied between the rear housing 18 taken as the positive electrode and a counterpart electrode taken as the negative electrode. The opposed sliding surface 180 of the rear housing 18 taken as the positive electrode is caused to face the negative electrode in the vicinity thereof, while the exposed surface 182 of the rear housing 18 has its back to the negative electrode and is disposed away therefrom.

According to the embodiments described above, the rear housing 18 may be formed not only from aluminum alloy containing 8 to 16% by mass of silicon but also from aluminum alloy containing 2 to 8% by mass of silicon. Hypereutectic base alloy generating a primary crystal silicon may be adopted as the aluminum-silicon based alloy. Moreover, not only the aluminum-silicon based alloy but also aluminum-copper based alloy, aluminum-magnesium based alloy, and aluminum-zinc based alloy may also be applied. Although the rear housing 18 is a die-cast article (foundry article), it may be a sand mold article, a gravity metal mold casting article, or a forged article. The first side plate 16 is a sintered article having oil retainability, but it may not have oil retainability in some cases. The first side plate 16 is an iron-based sintered article which is not quenched, but it may be quenched and hardened. The first side plate 16 may be based not only on iron but also on aluminum alloy. The hardness of the first side plate 16 may be approximately Hv 150 to 300, particularly Hv 180 to 250, approximately Hv 500 to 800, or approximately Hv 300 to 900.

According to the embodiments described above, this invention may be applied not only to the vane-type oil pump but also to a gear-type pump, an oil pump for a power steering device, or an oil pump used for other purpose. This invention may be applied not only to an oil pump but also to a compressor or to anything that has a rotary body and a base part. This invention can also be applied to, for example, a cam device that transmits rotation of a rotary body in the form of a direct forward movement.

The composition of the above-described electrolytic solution can be changed appropriately. For example, it is possible to use a solution containing a zirconium compound (zirconium hydroxide, 0.01 mol/litter), sodium pyrophosphate (0.015 mol/litter), and potassium hydrate (0.036 mol/litter) (the solution having a pH of 12 to 13). Also, a solution containing a zirconium compound (potassium zirconium carbonate, 0.01 mol/litter), potassium hydroxide (0.036 mol/litter), and hydrogen peroxide (0.02 mol/litter) (the solution having a pH of 11 to 12) may be used as the electrolytic solution. Moreover, a solution containing a zirconium compound (zirconium acetate, 0.01 mol/litter), sodium citrate dihydrate (0.01 mol/litter), and potassium hydrate (0.009 mol/litter) (the solution having a pH of 8 to 9) may be used as the electrolytic solution.

This invention is not limited to the embodiments described above, but can be implemented in various appropriate modifications without departing from the scope of the invention. Any combination of characteristics of a plurality of embodiments may be utilized.

This invention is suitably used in, for example, rotary equipment such as an oil pump installed in a vehicle. For example, this invention is suitably used in an oil pump that is used in hydraulic equipment such as a power steering device of a vehicle.

What is claimed is:

1. A rotary equipment, comprising:

a base part comprising a plurality of split bodies, having a working chamber; and a rotor, provided rotatably in the working chamber and having a sliding surface, wherein at least one of the plurality of the split bodies is made of an aluminum alloy and has an opposed sliding surface formed of a ceramic film that contains α-alumina and zirconia having a hardness of approximately Hv 500 to 1100 and a surface roughness of approximately 2 to 8 micrometers, and wherein the opposed sliding surface of the at least one of the plurality of the split bodies faces the sliding surface of the rotor, which slides against the opposed sliding surface.

2. The rotary equipment according to claim 1, wherein the ceramic film is formed by plasma electrolytic processing.

3. An oil pump, comprising:

a base part comprising a plurality of split bodies, having a working chamber, a suction port and a discharge port which communicate with the working chamber; and a rotor which is provided rotatably in the working chamber, suctions oil from the suction port and discharges the oil from the discharge port by rotating, and having a sliding surface, wherein at least one of the plurality of the split bodies is made of an aluminum alloy, and has an opposed sliding surface formed of a ceramic film that contains α-alumina and zirconia having a hardness of approximately Hv 500 to 1100 and a surface roughness of approximately 2 to 8 micrometers, and wherein the opposed sliding surface of the at least one of the plurality of the split bodies faces the sliding surface of the rotor, which slides against the opposed sliding surface.

4. The oil pump according to claim 3, wherein the ceramic film is formed by plasma electrolytic processing.

5. The oil pump according to claim 3, wherein the rotor has a rotatable rotor main body having a groove on an outer peripheral surface of the rotor main body, and a vane that is fitted into the groove of the rotor main body and activated in a centrifugal direction and centripetal direction as the rotor rotates, and wherein the ceramic film of the opposed sliding surface faces a sliding surface of the vane in contact with the sliding surface of the vane.

6. The oil pump according to claim 3, wherein the aluminum alloy contains 1 to 25% by mass of silicon.

7. The oil pump according to claim 3, wherein the ceramic film has a thickness of 2 to 300 micrometers.

8. The oil pump according to claim 3, wherein the rotor is held between the ceramic film formed on the opposed sliding surface of the split body and an oil-containing member disposed in the working chamber.

9. The oil pump according to claim 3, wherein the plurality of split bodies include a front housing and a rear housing.

10. The oil pump according to claim 3, wherein the ceramic film has a hardness of Hv 700 to 1000.

11. The oil pump according to claim 3, wherein the ceramic film has a surface roughness of 4 to 8 micrometers.

* * * * *